US006000139A

United States Patent [19]

Chan

[11] Patent Number: 6,000,139

[45] Date of Patent: Dec. 14, 1999

[54] PAPER PUNCH

[75] Inventor: Yip Kwong Chan, Kwai Chung, The Hong Kong Special Administrative Region of the People's Republic of China

[73] Assignee: Y & H Industrial Limited, New Territories, The Hong Kong Special Administrative Region of the People's Republic of China

[21] Appl. No.: 09/035,918

[22] Filed: Mar. 6, 1998

[51] Int. Cl.[6] ..... B26F 1/02

[52] U.S. Cl. ..... 30/358; 30/278; 83/385

[58] Field of Search ..... 30/278, 279.2, 30/314, 315, 358, 360, 361; 83/685, 686

[56] References Cited

U.S. PATENT DOCUMENTS

| | | | |
|---|---|---|---|
| 236,956 | 1/1881 | Nuebling | 30/358 |
| 1,138,860 | 5/1915 | Gladwin | 30/358 |
| 1,467,637 | 9/1923 | Hatch | 83/685 |
| 3,079,824 | 3/1963 | Schott | 83/686 |
| 3,715,947 | 2/1973 | Weisbeck et al. | 83/685 |
| 3,741,056 | 6/1973 | Saladin | 83/685 |
| 3,863,341 | 2/1975 | Ramer | 30/358 |
| 3,906,633 | 9/1975 | Inoue | 30/358 |
| 5,495,671 | 3/1996 | Shun-Yi | 30/358 |
| 5,601,006 | 2/1997 | Quinn et al. | 83/686 |

*Primary Examiner*—Hwei-Siu Payer
*Attorney, Agent, or Firm*—Leydig, Voit & Mayer, Ltd.

[57] ABSTRACT

A paper punch comprising a body having upper and lower parts and providing a horizontal gap between the body parts, a rotatable male die having a cross-section of a specific shape and supported within the upper body part for vertical movement, and a spring provided inside the upper body part for biassing the male die upwards. The paper punch includes a rotatable female die having a hole of substantially the same shape and size and provided within the lower body part, and a guiding member provided within the upper body part for guiding the male die in vertical alignment with the female die. A rotatable press-knob is provided on the upper body part for moving the male die downwards, against the action of the spring, to perform one of the two following actions. The first action is cooperating with the female die for making a hole on a sheet of paper inserted into the gap. The second action is engaging with the female die for simultaneous rotation by the press-knob to change the orientation of the hole to be made.

11 Claims, 7 Drawing Sheets

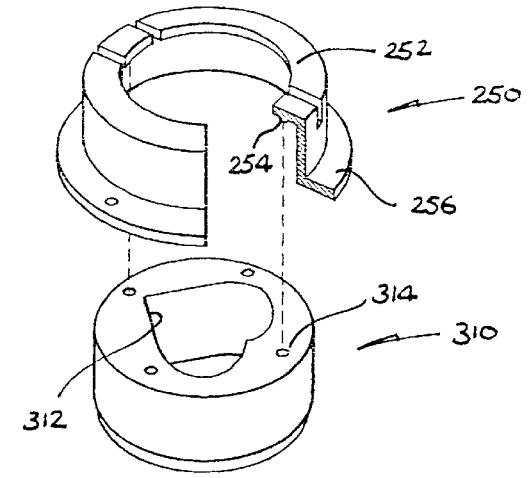
FIG. 4
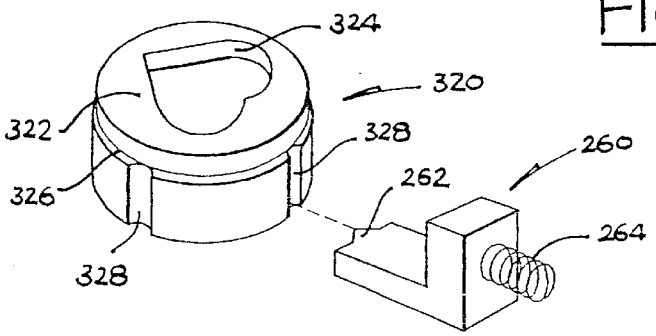
FIG. 5
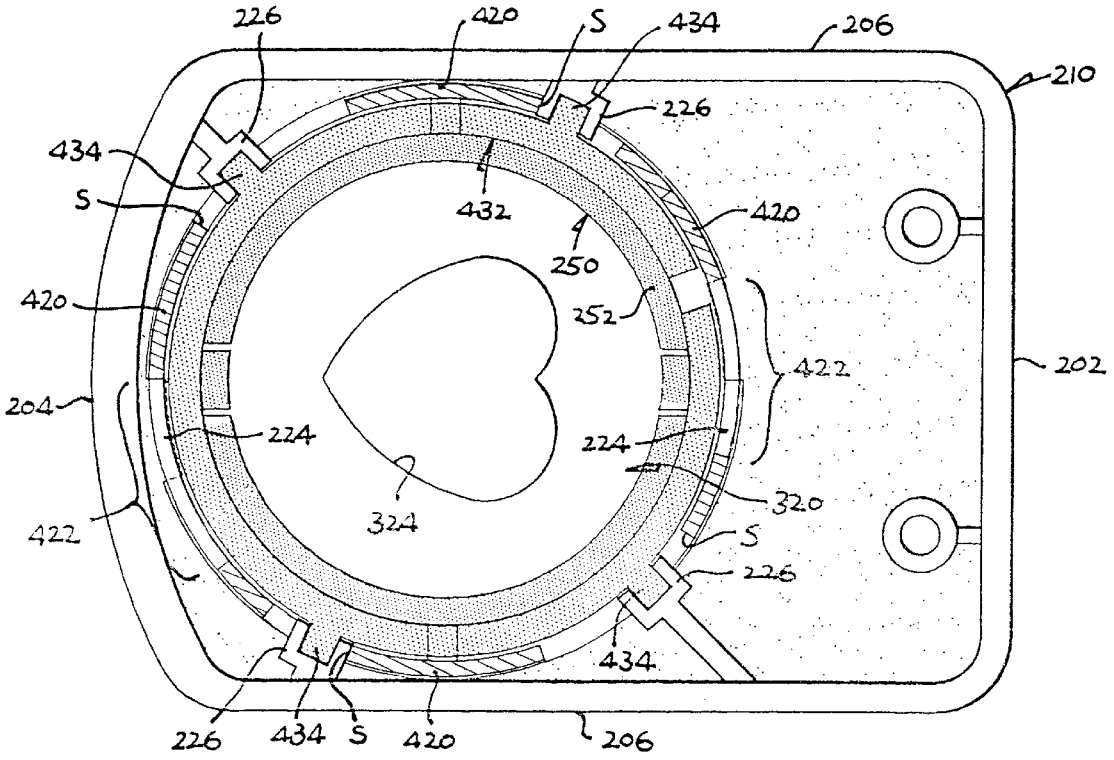

PAPER PUNCH

BACKGROUND OF THE INVENTION

Paper punches for handicrafts are known to exist for making a hole on a sheet of paper or the like. As the hole to be made is usually of a decorative shape, such as a heart, bird or flower, its orientation dictates the side of the paper sheet on which the paper punch may be used for making a hole of the correct, upright orientation.

The invention seeks to mitigate or at least alleviate this problem by providing a paper punch which may be used on every side of a paper sheet to make a hole of the correct orientation.

SUMMARY OF THE INVENTION

According to the invention, there is provided a paper punch comprising a body having upper and lower parts and providing a planar gap between the body parts, a rotatable male punching member having a cross-section of a specific shape and supported within the upper body part for upward and downward movement along an axis, a spring provided inside the upper body part for biassing the male punching member upwards, a rotatable female punching member having a hole of substantially the same shape and size and provided within the lower body part, a guiding member provided within the upper body part and having a hole for guiding the male punching member in alignment with the female punching member along the axis, and a rotatable press member provided on-the upper body part for moving the male punching member downwards, against the action of the spring, to perform one of the following actions: (1) co-operating with the female punching member for making a hole on a sheet of material inserted into the gap and (2) engaging with the female punching member for simultaneous rotation by the press member to change the orientation of the hole to be made.

Preferably, the paper punch includes means to define a plurality of predetermined positions for the female punching member.

More preferably, said means are provided by a plurality of formations on the female punching member and a spring-loaded slider releasably engageable with the formations.

In a preferred embodiment, the hole of the guiding member is made to be have substantially the same shape and size as the cross-section of the male punching member for simultaneous rotation with the male punching member.

More preferably, the paper punch includes means to define a plurality of predetermined positions for the guiding member.

It is preferred that said means are provided by a plurality of formations on the guiding member and a co-axial cap having a resiliently deformable part releasably engageable with the formations.

In a preferred embodiment, the paper punch further includes a locking member provided on the upper body part for locking the press member against relative rotation.

More preferably, the locking member is in the form of a ring disposed around the press member for rotation between a locking position locking the press member and an unlocking position in which the press member is unlocked.

It is further preferred that the locking member and the press member are provided with co-operable formations for inter-engagement against relative rotation of the press member, said formations being releasable apart when the press member is depressed relative to the locking member, whereupon the locking member is movable to an unlocking position in which the press member is unlocked.

More preferably, the locking member is arranged, in the unlocking position, to hold an upper end of the spring off for allowing the press member to stay in the depressed position.

It is further preferred that a ring member is provided at the upper end of the spring for acting upon the press member via the male punching member, said ring member having a side projection for being held off by the locking member in the unlocking position. dr

BRIEF DESCRIPTION OF DRAWINGS

The invention will now be more particularly described, by way of example only, with reference to the accompanying drawings, in which:

FIG. 4 is an exploded perspective view of four components of the paper punch of FIG. 2;

FIG. 5 is a cross-sectional top plan view of the paper punch of FIG. 2;

DETAILED DESCRIPTION OF PREFERRED EMBODIMENT

Figure 1:
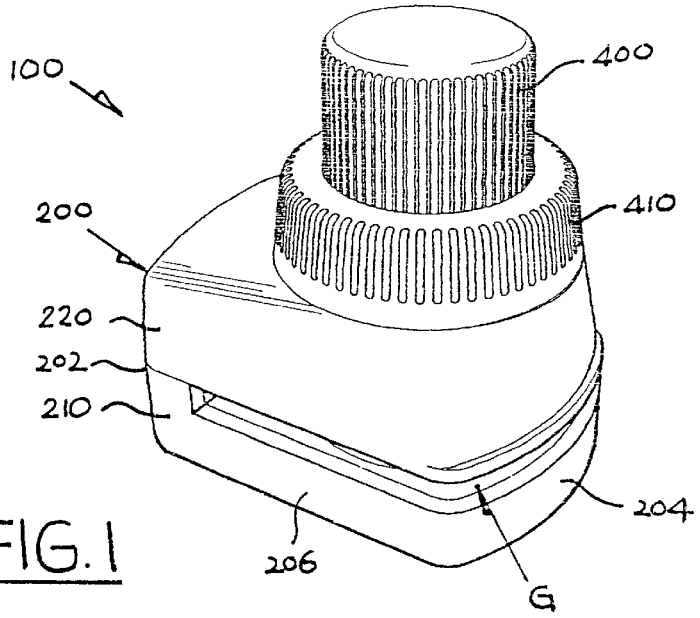
FIG. 1 is a perspective view of an embodiment of a paper punch in accordance with the invention.
Figure 2:
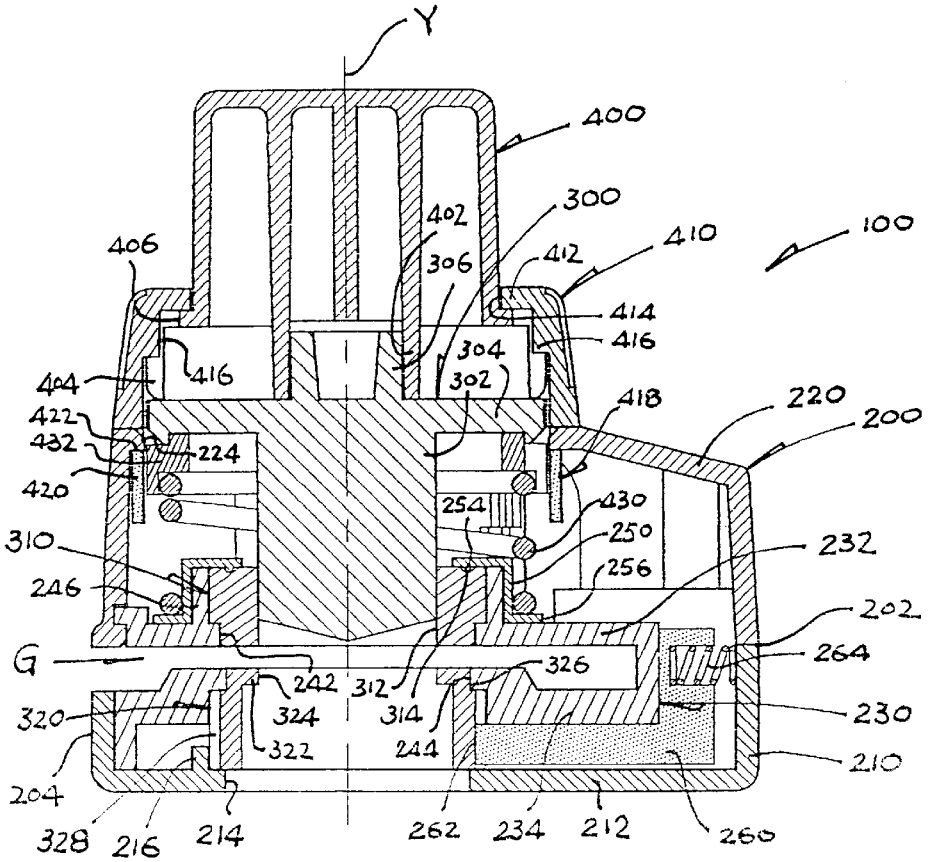
FIG. 2 is a cross-sectional side view of the paper punch of FIG. 1.
Figure 3:
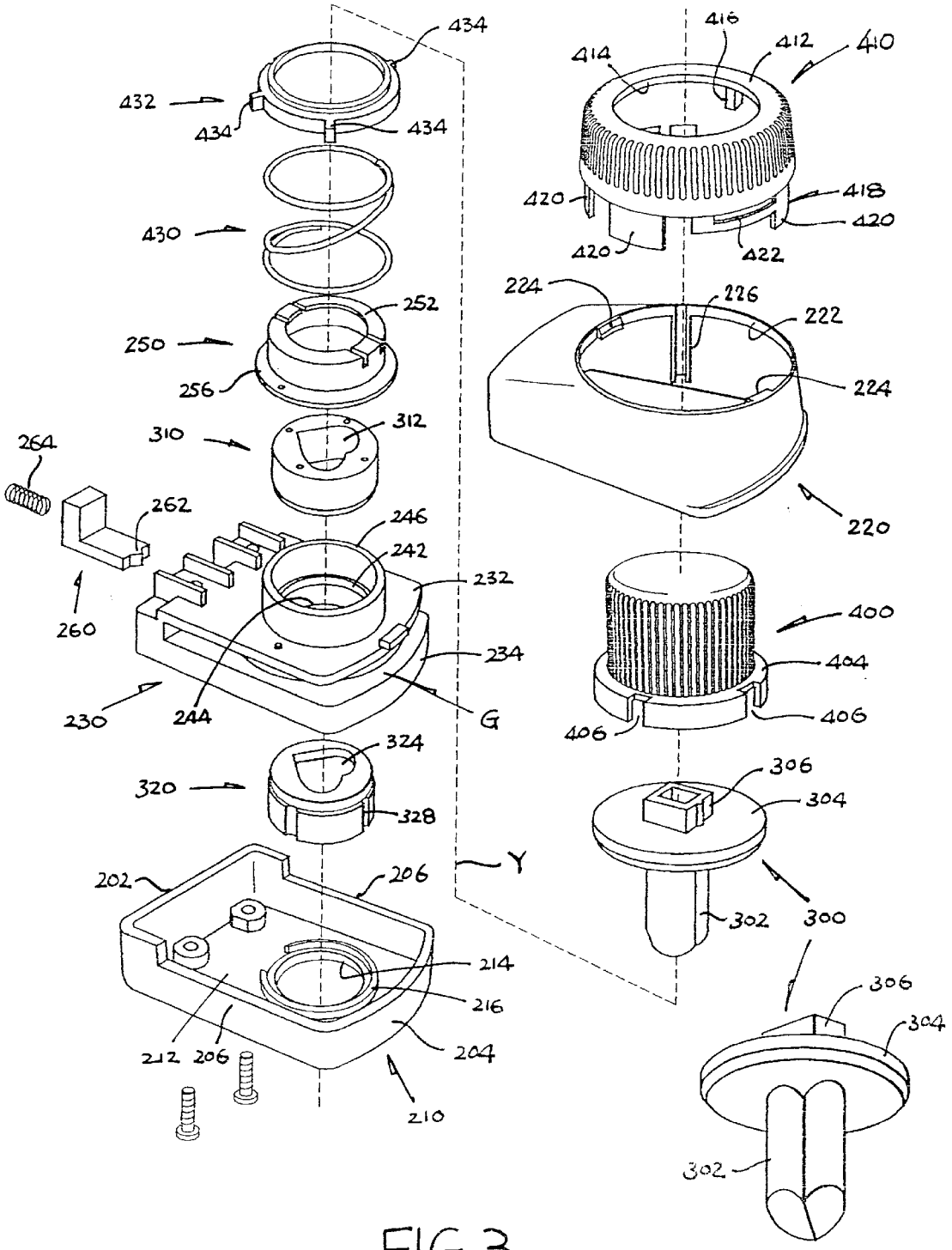
FIG. 3 is an exploded perspective view of the paper punch of FIG. 2.

Referring firstly to FIGS. 1 to 5 of the drawings, there is shown a paper punch 100 embodying the invention, which punch 100 comprises a plastic body 200 formed by a tray-like base 210 and a cover 220 fitted on the base 210. The is base 210 and cover 220 join together only along a rear side 202 of the body 200, thereby forming a flat horizontal gap G between them. The gap G opens through to the other three sides, namely front side 204 and left and right sides 206, of the body 200. The paper punch 100 includes a generally flat C-shaped die cast metal chassis 230 provided between the base 210 and the cover 220. The chassis 230 has a pair of upper and lower horizontal plates 232 and 234 fitted within the cover 220 and the base 210, respectively, with the gap between the plates 232 and 234 coinciding with the aforesaid gap G. The plates 232 and 234 are formed with respective upper and lower circular holes 242 and 244 about a common vertical axis Y. A slightly larger collar 246 is formed on and co-axially around the upper hole 242. The base 210 has a bottom wall 212 which is formed with a circular hole 214 about the axis Y and a slightly larger upstanding collar 216 co-axially around the hole 214.

The paper punch 100 further includes a single metal male punching die 300 and a pair of upper and lower metal female punching dies 310 and 320, for making a hole having, for example, a heart shape on a sheet of paper or the like inserted into the gap G. The male die 300 has a vertical central shank 302 having a cross-section of the same heart shape and size and includes an upper circular flange 304 and a square central top end piece 306. The female dies 310 and 320 have a generally flat cylindrical outer shape, and are positioned above and below the gap G, respectively.

The upper female die 310 is formed with a vertical central through hole 312 of the same heart shape and size and four equi-angularly spaced indents 314 (for every angle of 90°) on the top side. This female die 310 is placed within the collar 246 of the chassis upper plate 232 for rotation about the axis Y. A stationary plastic annular cap 250 is fitted co-axially over and around the collar 246 for holding the female die 310 in place.

The cap 250 has an apertured top wall 252 to fully expose the hearted-shaped hole 312 of the female die 310 below. The top wall 252 is formed, on the underside, with a pair of diametrically opposite pimples 254 for releasable engagement with any one opposite pair of the indents 314 of the female die 310 to define four predetermined angular positions for the die 310 (see FIG. 4). The top wall 252 on opposite sides of each pimple 254 is slit open such that the pimples 254 are resiliently bendable upwards by the top side of the female die 310 upon rotation, thereby allowing the die 310 to rotate. The cap 250 includes a flange 256 around its bottom.

The lower female die 320 has a relatively thin top wall 322 in which a central through hole 324 of the same heart shape and size is formed. This female die 320 is placed between the chassis lower plate 234 and the base bottom wall 212 for rotation about the axis Y. The female die 320 sits within the base bottom wall collar 216 and has a top peripheral step 326 retained by the rim of the chassis lower plate hole 244. Four equi-angularly spaced vertical grooves 328 (for every angle of 90°) are formed around the outer side of the die 320.

A plastic slider 260, which has a pointed front end 262 pointing at the lower female die 320 from one side, is provided between the chassis 230 and the base bottom wall 212. A rear spring 264 is used to resiliently bias the slider 260 forwards, thereby causing the front end 262 to engage with any one of the grooves 328 of the female die 320 for defining four predetermined angular positions for the die 320 (see FIG. 4). These predetermined positions of the lower female die 320 correspond to those of the upper female die 310 with respect to the orientation of their corresponding heart-shaped holes 312 and 324 such that the two holes 312 and 324 are in angular alignment with each other.

The paper punch 100 further includes a plastic press-knob 400 and a plastic ring-knob 410 disposed co-axially around the press-knob 400. The press-knob 400 has a hollow square central bottom end piece 402 for engaging with the top end piece 306 of the male die 300 such that the male die 300 is rotatable by the means of the press-knob 400. The press-knob 400 includes a radially enlarged bottom portion 404, around which four equi-angularly spaced notches 406 (for every angle of 90°) are formed. The ring-knob 410 has a top wall 412 formed with a circular central hole 414 for the body of the press-knob 400 to pass through from below, with the enlarged bottom portion 404 retained inside the ring-knob 410. A pair of diametrically opposite teeth 416 is formed on the underside of the top wall 412 for engaging with any one opposite pair of the notches 406, thereby fixing the orientation of the press-knob 400 with respect to the ring-knob 410. The ring-knob 410 includes a bottom skirt 418 having a slightly reduced diameter and consisting of four discrete parts 420, of which one opposite pair is formed with respective horizontal slots 422.

Returning to the cover 220, it has a top circular hole 222 about the axis Y and receiving the skirt 418, whereby the ring-knob 410 is rotatably disposed atop the cover 220. The hole 222 has, on the innerside of its rim, a pair of opposed teeth 224 slidably engaging with respective slots 422 such that the ring-knob 410 is only rotatable through an angle of about 10° between a locking position and an unlocking position. The cover 220 includes four internal channels 226 which extend vertically down from the rim of the hole 222 to reach almost the bottom of the cover 220. The channels 226 are formed adjacent to same sides S of the four parts 420 of the skirt 418 respectively (FIG. 5) such that the channels' upper halves will be closed by the skirt parts 420 when, but only when, the ring-knob 410 is in the unlocking position.

As described above, the press-knob 400 co-axially passes from below through the ring-knob 410 and engages with the male die 300 immediately below. The male die 300, together with the press-knob 400, is resiliently biassed upwards by means of a helical spring 430. The lower end of the spring 430 is disposed around the cap 250 and bears against the bottom flange 256. A plastic ring 432 is provided co-axially at the upper end of the spring 430 for bearing against the underside of the male die flange 304. The ring 432 has four outer teeth 434 which engage slidably with the channels 226, respectively, such that the ring 432 is not rotatable but only movable up and down inside the cover 220.

While the ring-knob 410 is in the unlocking position, the extent to which the ring 432 is movable upwards (by the spring 430) is limited by the skirt parts 420 closing the upper halves of the channels 226 and thus blocking the ring teeth 434. When the ring-knob 410 is rotated to the locking position, the ring teeth 434 are allowed to move upwards into the upper halves of the channels 226 (under the action of the spring 430), where they will block the ring-knob 410 from rotating back by the sides S of the skirt parts 420. Accordingly, the ring-knob 410 is not rotatable in either direction when it is in the locking position, thereby locking the press-knob 400 in a fixed angular position with respect to the body 200 through the engagement between the teeth 416 of the ring-knob 410 and the notches 406 of the press-knob 400.

Figure 6A:
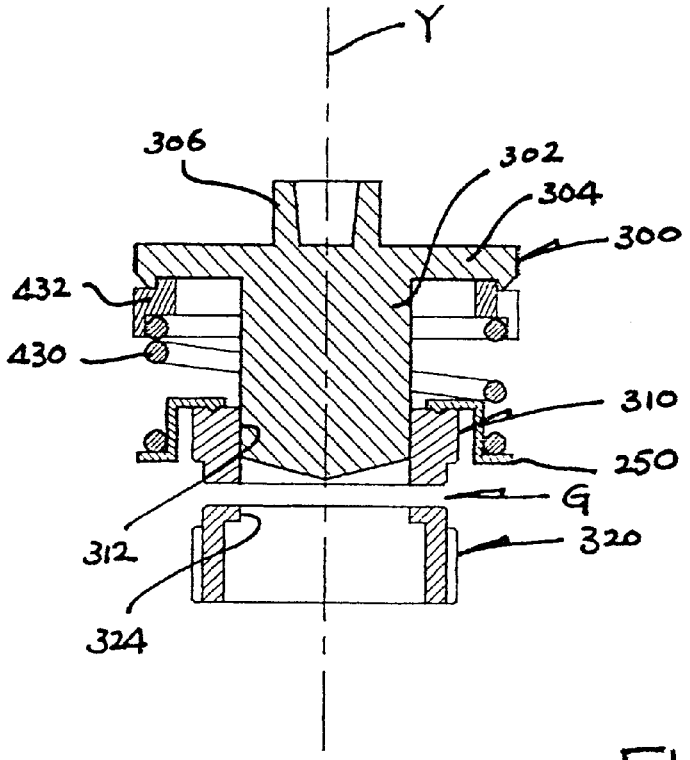
FIGS. 6A and 6B are partial cross-sectional side views of the paper punch FIG. 2, shown in different operating conditions.
Figure 6B:
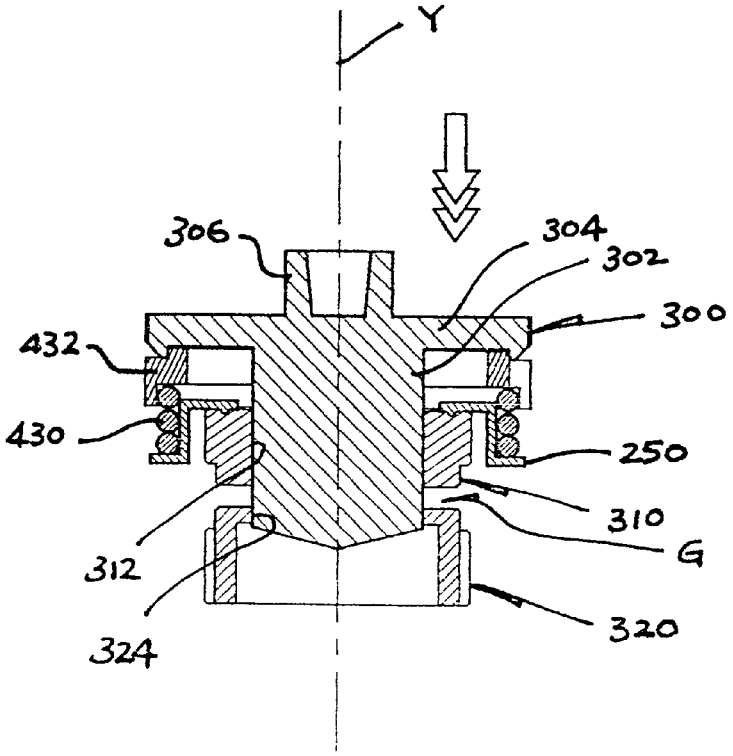
Figure 7A:
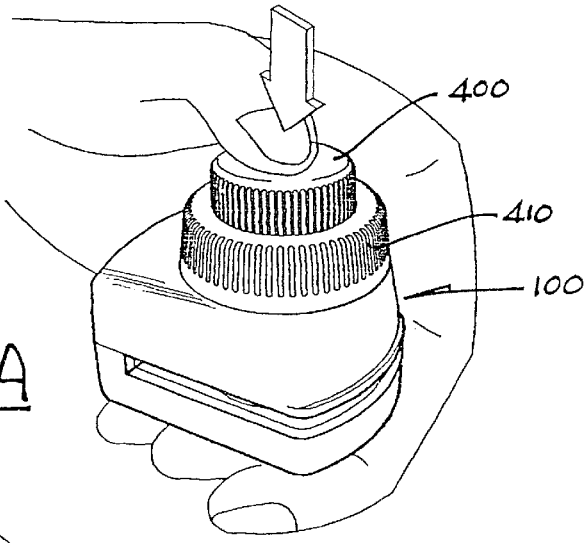
FIGS. 7A to 7E are perspective views illustrating the operation of the paper punch of FIG. 1.
Figure 7B:
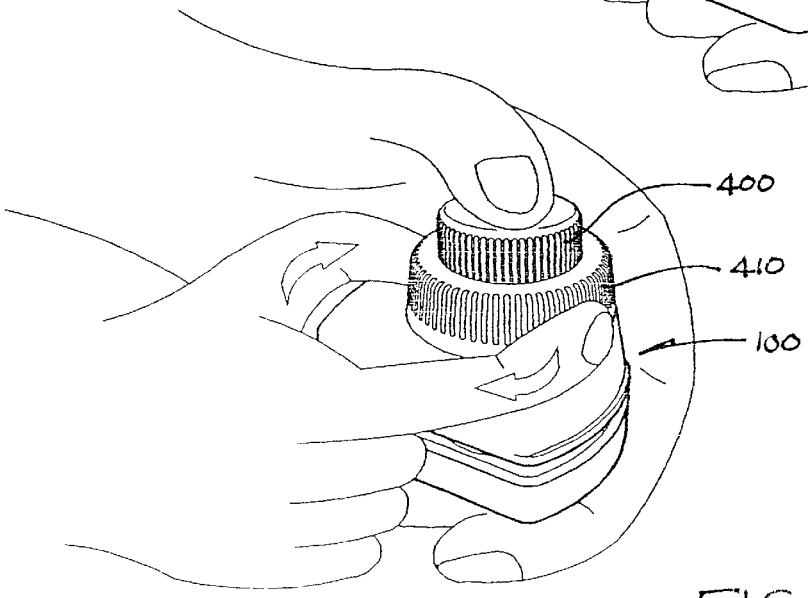
Figure 7C:
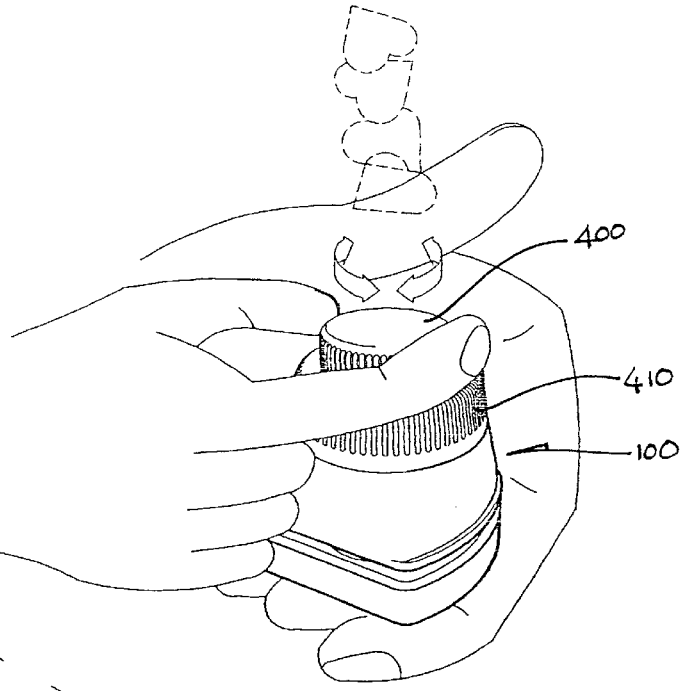
Figure 7D:
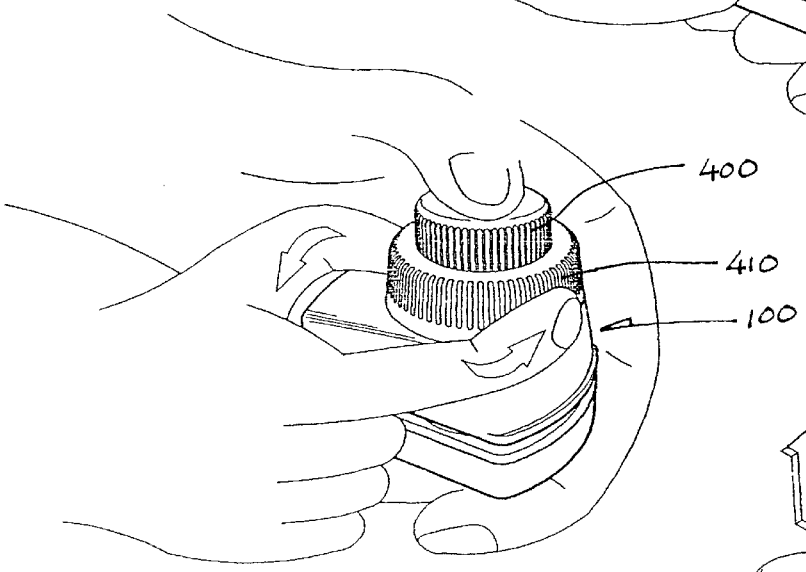
Figure 7E:
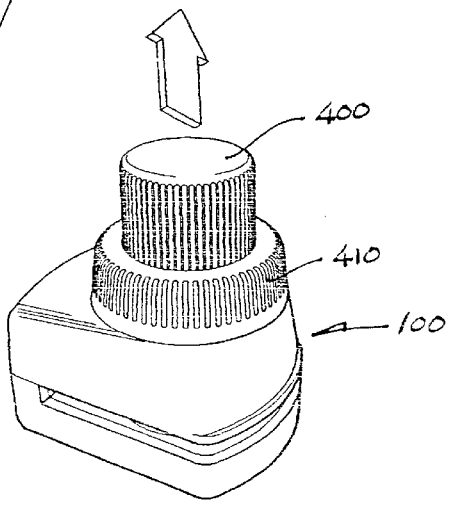

Referring now to FIGS. 6A and 6B, the shank 302 of the male die 300 engages, and will remain in engagement, with the hole 312 of the upper female die 310 below. Manual depression of the press-knob 400 will move the male die 300 downwards and will, in turn, cause the shank 302 to extend across the gap G and then through the hole 324 of the lower female die 320, thereby punching out a heart-shaped hole on a sheet of paper inserted into the gap G. Upon release of the press-knob 400, the male die 300 is raised back up by the spring 430.

The upper female die 310 does not play any direct role in the described punching action. Its major function is to guide the shank 302 of the male die 300 in vertical alignment with the hole 324 of the lower female die 320, thereby ensuring a smooth entry of the shank 302 into and through the hole 324, particularly after the orientation of the male die 300 and lower female die 320 has been changed as described below.

Reference is finally made to FIGS. 7A to 7E and FIGS. 8A to 8D of the drawings. The orientation of the heart-shaped hole to be punched out may be changed through one or more angles of 90° so that the hole may be made on either the top, left, right or bottom side of the sheet of paper in the upright position. This is achieved by rotating the male die 300 and the lower female die 320 simultaneously by means of the press-knob 400.

Figure 8A:
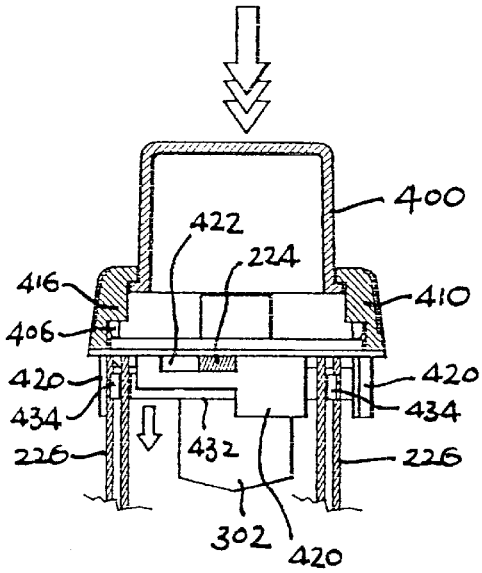
FIGS. 8A to 8D are partial cross-sectional side views illustrating the operation of the paper punch as in FIGS. 7A to 7E.
Figure 8B:
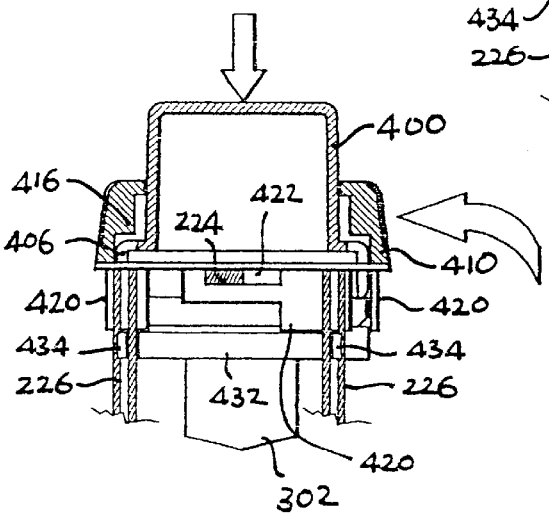
Figure 8C:
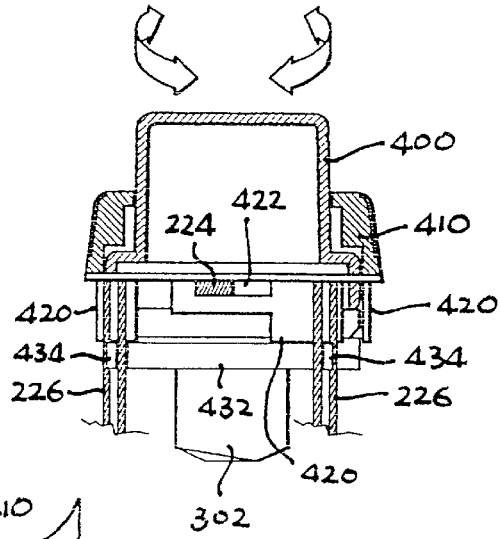
Figure 8D:
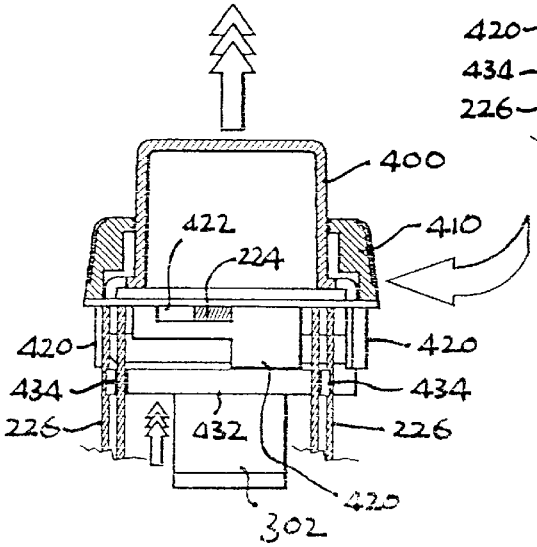

Initially, the press-knob 400 is depressed (FIG. 7A) to release its notches 406 from the teeth 416 of the ring-knob 410 (FIGS. 8A to 8B) for subsequent rotation. The ring-knob 410 is then rotated from the locking position to the unlocking position (FIG. 7B) to have its skirt parts 420 holding off the ring 432 by the teeth 434 for allowing the press-knob 400 to stay in the depressed position (FIG. 8B). Subsequently, the press-knob 400 is rotated to the appropriate angular position (FIGS. 7C and 8C), which is indicated by a click when the front end 262 of the slider 260 comes into engagement with the corresponding groove 328 of the lower female die 320. At this position, the notches 406 of the press-knob 400 will re-align with the teeth 416 of the ring-knob 410. The ring-knob 410 is finally rotated back to the locking position (FIG. 7D) in order to move the skirt parts 420 sideways off the teeth 434 of the ring 432 (FIG. 8D), whereupon the press-knob 400 is ejected back up (FIG. 7E) by the spring 430. The paper punch 100 is now ready for use.

As the upper female die 310 remains at all time in angular engagement with the shank 302 of the male die 300, it will be rotated simultaneously with the shank 302 to the same new position. This new position of the female die 310 coincides with one of the four positions predetermined by the engagement between the indents 314 and the pimples 254 described above. Thus the female die 310 will remain in action for guiding the shank 302 of the male die 300 in vertical alignment with the hole 324 of the lower female die 320.

It is envisaged that the upper part of the shank 302 of the male die 300 may be made to be circular in cross-section, with the lower part of the shank 302 remaining in the heart shape for punching. In this slightly different embodiment, the hole 312 of the upper female die 310 is also made to be circular and of the same size for guiding the shank 302 by said upper part in vertical alignment with the lower female die 310 below, without the need for the upper female die 310 to be rotatable.

As described above, when the press-knob 400 is depressed, its notches 406 will be disengaged from the teeth 416 of the ring-knob 410. Accordingly, while in this depressed position, the press-knob 400 may already be rotated without the need to rotate the ring-knob 410 first to the unlocking position. The unlocking position for the ring-knob 410 is provided to facilitate the rotation of the press-knob 400 without the need to keep pressing it down at the same time.

The invention has been given by way of example only, and various other modifications of and/or alterations to the described embodiments may be made by persons skilled in the art without departing from the scope of the invention as specified in the appended claims.

What is claimed is:

1. A paper punch comprising a body having upper and lower parts and providing a planar gap between the body parts, a rotatable male punching member having a cross-section of a specific shape and supported within the upper body part for upward and downward movement along an axis, a spring provided inside the upper body part for biasing the male punching member upwards, a rotatable female punching member having a hole of substantially the same shape and size as the male punching member and provided within the lower body part, a guiding member provided within the upper body part and having a hole for guiding the male punching member in alignment with the female punching member along the axis, and a rotatable press member extending outwards from the upper body part and adapted for grasping by a hand of a user of the punch and movable upward and downward with respect to the upper body part for moving the male punching member downwards, against the action of the spring, to engage the female punching member for making a hole on a sheet of material inserted into the gap, the male punching member being connected to the press member for rotation with the press member about the axis when the press member is rotated about the axis by the hand of the user, the female punching member being simultaneously rotatable with the male punching member and the press member about the axis when the male punching member engages the female punching member and the press member is rotated about the axis by the hand of the user.

2. A paper punch as claimed in claim 1, including means to define a plurality of predetermined positions for the female punching member.

3. A paper punch as claimed in claim 1, wherein the hole of the guiding member has substantially the same shape and size as the cross-section of the male punching member for simultaneous rotation with the male punching member.

4. A paper punch as claimed in claim 3, including means to define a plurality of predetermined positions for the guiding member.

5. A paper punch comprising a body having upper and lower parts and providing a planar gap between the body parts, a rotatable male punching member having a cross-section of a specific shape and supported within the upper body part for upward and downward movement along an axis, a spring provided inside the upper body part for biasing the male punching member upwards, a rotatable female punching member having a hole of substantially the same shape and size as the male punching member and provided within the lower body part and having a plurality of formations, a spring-loaded slider releasably engageable with the formations to define a plurality of predetermined positions for the female punching member, a guiding member provided within the upper body part and having a hole for guiding the male punching member in alignment with the female punching member along the axis, and a rotatable press member provided on the upper body part for moving the male punching member downwards, against the action of the spring, to perform one of the following actions: (1) co-operating with the female punching member for making a hole on a sheet of material inserted into the gap and (2) engaging with the female punching member for simultaneous rotation by the press member to change the orientation of the hole to be made.

6. A paper punch comprising a body having upper and lower parts and providing a planar a between the body parts, a rotatable male punching member having a cross-section of a specific shape and supported within the upper body part for upward and downward movement along an axis a spring provided inside the upper body part for biasing the male punching member upwards, a rotatable female punching member having a hole of substantially the same shape and size as the male punching member and provided within the lower body part, a guiding member provided within the upper body part and having a hole for guiding the male punching member in alignment with the female punching member along the axis, the hole of the guiding member having substantially the same shape and size as the cross-section of the male punching member for simultaneous rotation with the male punching member, a plurality of formations on the guiding member and a co-axial cap having a resiliently deformable part releasably engageable with the formations to define a plurality of predetermined positions for the guiding member, and a rotatable press member provided on the upper body part for moving the male punching member downwards, against the action of the spring to perform one of the following actions: (1) co-operating with the female punching member for making a hole on a sheet of material inserted into the gap and (2) engaging with the female punching member for simultaneous rotation by the press member to change the orientation of the hole to be made.

7. A paper punch comprising a body having upper and lower parts and providing a planar gap between the body parts, a rotatable male punching member having a cross-section of a specific shape and supported within the upper body part for upward and downward movement along an axis, a spring provided inside the upper body part for biasing the male punching member upwards, a rotatable female punching member having a hole of substantially the same shape and size as the male punching member and provided within the lower body part, a guiding member provided within the upper body part and having a hole for guiding the male punching member in alignment with the female punching member along the axis, a rotatable press member provided on the upper body part for moving the male punching member downwards, against the action of the spring, to perform one of the following actions: (1) cooperating with the female punching member for making a hole on a sheet of material inserted into the gap and (2) engaging with the female punching member for simultaneous rotation by the press member to change the orientation of the hole to be made, and a locking member provided on the upper body part for locking the press member against relative rotation.

8. A paper punch as claimed in claim 7, wherein the locking member is in the form of a ring disposed around the press member for rotation between a locking position locking the press member and an unlocking position in which the press member is unlocked.

9. A paper punch as claimed in claim 7, wherein the locking member and the press member are provided with co-operable formations for inter-engagement against relative rotation of the press member, said formations being releasable apart when the press member is depressed relative to the locking member, whereupon the locking member is movable to an unlocking position in which the press member is unlocked.

10. A paper punch as claimed in claim 9, wherein the locking member is arranged, in the unlocking position, to hold an upper end of the spring off for allowing the press member to stay in the depressed position.

11. A paper punch as claimed in claim 10, wherein a ring member is provided at the upper end of the spring for acting upon the press member via the male punching member, said ring member having a side projection for being held off by the locking member in the unlocking position.

* * * * *